United States Patent [19]

Popescu

[11] 4,077,855

[45] Mar. 7, 1978

[54] BRIGHT NICKEL ELECTROPLATING BATH AND PROCESS

[76] Inventor: Francine Popescu, 32 rue E. Dolet 94, St. Maur, France

[21] Appl. No.: 683,061

[22] Filed: May 4, 1976

[51] Int. Cl.[2] ..... C25D 3/16

[52] U.S. Cl. ..... 204/49

[58] Field of Search ..... 204/49, 43 T, 43 N, 204/43 P, 112; 106/1

[56] References Cited

U.S. PATENT DOCUMENTS

| | | | |
|---|---|---|---|
| 2,469,727 | 5/1949 | Hoffman | 204/49 |
| 2,781,305 | 2/1957 | Brown | 204/49 |
| 3,006,822 | 10/1961 | Todt | 204/49 |
| 3,723,260 | 3/1973 | Rushmere | 204/49 |

FOREIGN PATENT DOCUMENTS

| | | | |
|---|---|---|---|
| 1,190,288 | 4/1965 | Germany | 204/49 |
| 1,496,802 | 4/1969 | Germany | 204/49 |
| 307,487 | 1/1969 | Sweden | 204/49 |

*Primary Examiner*—G. L. Kaplan

*Attorney, Agent, or Firm*—Gifford, Chandler, Sheridan & Sprinkle

[57] ABSTRACT

A primary brightener for use in aqueous nickel electroplating baths has the following general formula:

wherein:

$R_1$ is methyl, ethyl or a hydroxyethyl radical;

$R_2$ is alkenyl, alkynyl, hydroxy-substituted alkynyl or lower alkyl-substituted alkynyl;

$R_3$ is lower alkylene, lower alkoxyalkylene, lower alkynylene, lower alkoxy-alkenylene, hydroxy-substituted lower alkylene, carboxy-substituted lower alkylene or hydroxy- and methyl-substituted lower aminoalkylene;

$R_4$ is a sulfonic radical (—$SO_3$—) or an aliphatic carboxyester group where $R_5$ is alkyl, alkenyl, alkynyl, alkoxyalkynyl, dialkoxyalkynyl, hydroxyalkyl, hydroxyalkenyl, hydroxyalkynyl, haloalkyl, halohydroxyalkyl, halohydroxyalkynyl or hydroxyalkoxyalkynyl; and X is halogen or hydroxy when the positive charge on the nitrogen atom is not otherwise neutralized and X is absent when said charge is neutralized by another substituent of the molecule.

14 Claims, No Drawings

BRIGHT NICKEL ELECTROPLATING BATH AND PROCESS

FIELD OF THE INVENTION

This invention relates to the electrodeposition of bright nickel from aqueous acidic nickel electroplating baths and, more particularly, to new brighteners and addition agents and their application for bright nickel electroplating.

It is an object of this invention to provide new compounds which can be used as primary (or principal) brighteners in aqueous nickel electroplating baths in order to obtain ductile, levelled and highly brilliant nickel deposits under a wide range of current densities.

It is a further object of this invention to provide an efficient process for electrodepositing bright nickel deposits. Another object of this invention is to provide bath compositions for nickel plating from which bright nickel electrodeposits are obtained.

STATEMENT OF THE INVENTION

Nickel is electrodeposited from an aqueous acidic nickel electroplating bath containing a source of nickel ions and, as the primary brightening agent, about 0.01 to 3.0 grams per liter of bath of a compound having the formula:

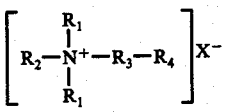

(I)

wherein:

$R_1$ is methyl, ethyl, or hydroxyethyl radical;

$R_2$ is alkenyl, alkynyl, hydroxy-substituted alkynyl or lower alkyl-substituted alkynyl $R_3$ is lower alkylene, lower alkoxyalkylene, lower alkenylene, lower alkoxyalkenylene, hydroxy-substituted lower alkylene, carboxy-substituted lower alkylene or hydroxy-and methyl-substituted lower aminoalkylene;

$R_4$ is a sulfonic radical ($—SO_3—$) or an aliphatic carboxyester group

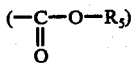

where $R_5$ is alkyl, alkenyl, alkynyl, alkoxyalkynyl, dialkoxyalkynyl, hydroxyalkyl, hydroxyalkenyl, hydroxyalkynyl, haloalkyl, halohydroxyalkyl, halohydroxyalkynyl or hydroxyalkoxyalkynyl; and X is halogen or hydroxy when the positive charge on on the nitrogen atom is not otherwise neutralized and X is absent when said charge is neutralized by another substituent of the molecule.

The term "lower" means herein that the group contains 1 to 6 carbon atoms.

A general way to prepare the compounds of formula (I) is to react an aliphatic unsaturated (ethylenic or acetylenic) tertiary amine with a quaternizing agent selected from the following classes of compounds:

(a) aliphatic, alpha-beta unsaturated acids and their aliphatic esters;
(b) haloalkyl sulfonic acids and their alkali metal salts;
(c) haloalkylamino sulfonic acids and their alkali metal salts;
(d) alkysultones;
(e) haloalkene sulfonic acids and their alkali metal salts;
(f) aliphatic unsaturated sulfonic acids and their alkali metal salts;
(g) aliphatic, saturated, halogenated acids and their alkali metal salts;
(h) aliphatic esters of aliphatic halogenated acids.

The quaternization reaction of the unsaturated amine is effected according to the known methods of quaternization at the nitrogen atom preferably in aqueous or alcoholic medium and at a temperature in the range of about 50–110° C. Alkaline or acidic catalysts of the reaction may be used, depending on the nature of the quarternizing agent. The reactants are generally present in equimolar proportions.

Table 1 gives some non-restrictive examples of unsaturated amines which may be used, according to this invention, for the preparation of brighteners of formula (I):

TABLE 1

UNSATURATED AMINES

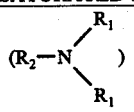

| | | |
|---|---|---|
| 1) | Dimethyl-vinylamine | $(CH_3)_2N—CH=CH_2$ |
| 2) | Diethyl-vinylamine | $(C_2H_5)_2N—CH=CH_2$ |
| 3) | Dimethyl-allylamine | $(CH_3)_2N—CH_2—CH=CH_2$ |
| 4) | Diethanol-allylamine | $(HOCH_2CH_2)_2N—CH_2—CH=CH_2$ |
| 5) | 1-Dimethylamino-Propyne-2 | $(CH_3)_2N—CH_2—C\equiv CH$ |
| 6) | 1-Diethylamino-propyne-2 | $(C_2H_5)_2N—CH_2—C\equiv CH$ |
| 7) | 1-Diethanolamino-Propyne-2 | $(HOCH_2CH_2)_2N—CH_2—C\equiv CH$ |
| 8) | 3-Dimethylamino-Butyne-1 | $(CH_3)_2N—CH(CH_3)—C\equiv CH$ |
| 9) | 4-Diethylamino-2-Butyne-1-OL | $(C_2H_5)_2N—CH_2—C\equiv C—CH_2—OH$ |
| 10) | 1-Diethylamino-pentyne-2-OL-4 | $(C_2H_5)_2N—CH_2—C\equiv C—CH(OH)—CH_3$ |
| 11) | 1.1-Dimethylpro-pyne-2-Ylamine | $H_2N—C(CH_3)_2—C\equiv CH$ |
| 12) | 1.1-Diethylpro-pyne-1-Ylamine | $H_2N—C(C_2H_5)_2—C\equiv CH$ |

Table 2 gives some non-restrictive examples of quaternizing agents which may be reacted with the unsaturated amines, in order to obtain nickel electroplating brighteners according to this invention:

TABLE 2

QUATERNIZING AGENTS

| | | |
|---|---|---|
| 1) | Acrylic acid | $CH_2=CH—COOH$ |
| 2) | Methacrylic acid | $CH_2=C(CH_3)—COOH$ |
| 3) | Vinylacetic acid | $CH_2=CH-CH_2—COOH$ |
| 4) | Itaconic Acid | $CH_2=C(COOH)—CH_2—COOH$ |
| 5) | Methyl acrylate | $CH_2=CH-CO.O—CH_3$ |

TABLE 2-continued

| QUATERNIZING AGENTS | |
|---|---|
| 6) Allyl acrylate | $CH_2{=}CH{-}CO\,.\,O{-}CH_2{-}CH{=}CH_2$ |
| 7) Acrylate of 2-Butyne-1, 4-diol | $CH_2{=}CH{-}CO\,.\,O{-}CH_2{-}C{\equiv}C{-}CH_2{-}OH$ |
| 8) Allylacetate of 2-Propyne-1-ol | $CH_2{=}CH{-}CH_2{-}CH_2{-}CO\,.\,O{-}CH_2{-}C{\equiv}CH$ |
| 9) Itaconate of 2-hydroxyethoxy-2-Propyne | $CH_2{=}C(COOH){-}CH_2{-}CO\,.\,O{-}CH_2{-}CH_2{-}O{-}CH_2C{\equiv}CH$ |
| 10) Acrylate of 1, 4-di-(beta-hydroxyethoxy)-2-Butyne | $CH_2{=}CH{-}CO\,.\,O(CH_2)_2OCH_2C{\equiv}CCH_2O(CH_2)_2OH$ |
| 11) 2-Chlorethane Sulfonic Acid (Na) | $Cl{-}CH_2{-}CH_2{-}SO_3Na$ |
| 12) 3-Bromopropane Sulfonic Acid (Na) | $Br{-}CH_2CH_2{-}SO_3Na$ |
| 13) 3-Chloro-2-Hydroxypropane sulfonic Acid (Na) | $Cl{-}CH_2{-}CH(OH){-}CH_2SO_3Na$ |
| 14) 3-Bromo-2-Methyl propane Sulfonic Acid | $Br{-}CH_2CH(CH_3){-}CH_2{-}SO_3H$ |
| 15) N-Chlorohydroxypropyl-N-Methyl-Taurine (Na salt) | $ClCH_2CH(OH)CH_2N(CH_3)CH_2CH_2SO_3Na$ |
| 16) Propansultone | $O{-}(CH_2)_3{-}SO_2$ |
| 17) Butansultone | $O{-}(CH_2)_4{-}SO_2$ |
| 18) 1-Chloro-2-Propene Sulfonic Acid | $Cl{-}CH_2CH{=}CH{-}SO_3H$ |
| 19) Sodium Allyl Sulfonate | $CH_2{=}CH{-}CH_2{-}SO_3Na$ |
| 20) Sodium Propyne Sulfonate | $CH{\equiv}C{-}CH_2{-}SO_3Na$ |
| 21) Sodium Chloroacetate | $Cl{-}CH_2{-}CO\,.\,O\,Na$ |
| 22) Chloro-2-Propionic Acid | $CH_3{-}CH(Cl){-}COOH$ |
| 23) Sodium Chloro-3-Propionate | $Cl{-}CH_2{-}CH_2{-}COONa$ |
| 24) Ethyl Chloroacetate | $Cl{-}CH_2{-}CO\,.\,O{-}CH_2{-}CH_3$ |
| 25) Allyl 3-Chloropropionate | $Cl{-}CH_2{-}CH_2{-}CO\,.\,O{-}CH_2{-}CH{=}CH_2$ |
| 26) Chloroacetate of 2-Methyl-3-Butyne-2-OL | $Cl{-}CH_2{-}CO\,.\,O{-}C(CH_3)_2{-}C{\equiv}CH$ |
| 27) 3-Chloropropionate of 1,4 (Beta-Hydroxy-Gamma-Chloro Propoxy)-2-Butyne | $ClCH_2CH_2CO\,.\,OCH(CH_2Cl)CH_2OCH_2C{\equiv}CCH_2OCH_2CH(OH){-}CH_2{-}Cl$ |
| 28) Alpha-Chloro-Acrylate of | $Cl{-}CH{=}CH{-}CO\,.\,O{-}CH_2{-}CH_2{-}C{\equiv}CH$ |

Table 3 gives some non restrictive examples of compounds of formula (I) which may be used as nickel electroplating brighteners:

TABLE 3

BRIGHTENERS OF FORMULA (I)

| Compound of formula (I) | Optimal concentration in the nickel bath (g/l) |
|---|---|
| 1) $H_2C{=}CH{-}N^+(CH_3)_2{-}CH_2{-}CH_2{-}C(=O){-}O^-$ | 0.05 - 0.5 |
| 2) $HC{\equiv}C{-}CH_2{-}N^+(CH_3)_2{-}CH_2{-}CH(CH_3){-}C(=O){-}O^-$ | 0.05 - 0.6 |
| 3) $[HC{\equiv}C{-}CH(CH_3){-}N^+(CH_3)_2{-}CH_2{-}CH_2{-}C(=O){-}O{-}CH_2{-}CH_3]\,OH^-$ | 0.03 - 0.4 |
| 4) $[HC{\equiv}C{-}CH_2{-}N^+(CH_3)_2{-}CH_2{-}CH_2{-}C(=O){-}O{-}CH_2{-}C{\equiv}C{-}CH_2{-}OH]\,OH^-$ | 0.05 - 1.0 |
| 5) $[H_2C{=}CH{-}CH_2{-}N^+(CH_2{-}CH_3)(CH_2CH_3){-}CH_2{-}CH(CH_3){-}C(=O){-}O{-}CH_2{-}C{\equiv}CH]\,Cl^-$ | 0.05 - 0.4 |
| 6) $[HC{\equiv}C{-}CH_2{-}N^+(CH_3)_2{-}CH_2{-}CH_2{-}C(=O){-}O{-}CH_2{-}CH_2{-}O{-}CH_2{-}C{\equiv}CH]\,OH^-$ | 0.03 - 0.3 |

TABLE 3-continued

BRIGHTENERS OF FORMULA (I)

| Compound of formula (I) | Optimal concentration in the nickel bath (g/l) |
|---|---|
| 7) $HC{\equiv}C{-}CH_2{-}N^+(CH_3)_2{-}CH_2{-}CH_2{-}SO_3^-$ | 0.05 - 1.0 |
| 8) $HC{\equiv}C{-}CH_2{-}N^+(CH_3)_2{-}CH_2{-}CH(OH){-}CH_2{-}SO_3^-$ | 0.03 - 1.5 |
| 9) $CH_3{-}CH(OH){-}C{\equiv}C{-}CH_2{-}N^+(CH_2{-}CH_3)_2{-}CH_2{-}CH(OH){-}CH_2{-}SO_3^-$ | 0.05 - 1.5 |
| 10) $HC{\equiv}C{-}CH_2{-}N^+(CH_3)_2{-}CH_2{-}CH(OH){-}CH_2{-}N(CH_3){-}CH_2{-}CH_2{-}SO_3^-$ | |
| 11) $HO{-}CH_2{-}C{\equiv}C{-}CH_2{-}N^+(CH_3)_2{-}CH_2{-}CH_2{-}CH_2{-}SO_3^-$ | 0.05 - 1.2 |
| 12) $HC{\equiv}C{-}CH(CH_3){-}N^+(CH_2{-}CH_2{-}OH)_2{-}CH_2{-}CH_2{-}CH_2{-}SO_3^-$ | 0.08 - 0.8 |
| 13) $[HC{\equiv}C{-}CH_2{-}N^+(CH_3)_2{-}CH_2{-}C(=O){-}O{-}C(CH_3)_2{-}C{\equiv}CH]\,OH^-$ | 0.08 - 0.7 |
| 14) $[HC{\equiv}C{-}CH_2{-}N^+(CH_2{-}CH_3)_2{-}CH{=}CH{-}C(=O){-}O{-}CH_2{-}CH_2{-}C{\equiv}CH]\,OH^-$ | |

The compounds of formula (I) are added to the nickel electroplating bath in a concentration of 0.01 to 3.0 grams per liter of bath, preferably 0.05 to 1.5 grams per liter of bath.

The brighteners of this invention can be associated in the nickel electroplating bath with aliphatic or aromatic sulfonated compounds known to the art as "secondary brighteners" or "brightener carriers". Examples of such secondary brighteners are o-benzoyl-sulfimide, the aryl sulfonates, the aryl sulfonamides, the aliphatic unsaturated sulfonic acids, and the like.

These secondary brighteners are added in the nickel plating bath in a concentration of 1.0 to 10.0 grams per liter of bath.

Table 4 gives some non-restrictive examples of sulfonic compounds which may be associated with the brighteners of formula (I) of this invention:

Table 4

| | Secondary Brighteners | |
|---|---|---|
| 1) | o-benzoyl sulfimide | $C_6H_4CONHSO_2$ |
| 2) | p-toluene sulfonamide | $CH_3C_6H_4SO_2NH_2$ |
| 3) | sodium meta-benzene disulfonate | $C_6H_4(SO_3Na)_2$ |
| 4) | sodium benzaldehyde-o-sulfonate | $C_6H_4(CHO)SO_3Na$ |
| 5) | sodium naphthalene trisulfonate | $C_{10}H_5(SO_3Na)_3$ |
| 6) | benzene sulfonamide | $C_6H_5{-}SO_2{-}NH_2$ |
| 7) | benzene disulfonimide | $C_6H_4(SO_2)_2NH$ |
| 8) | sodium vinyl sulfonate | $CH_2{=}CH{-}SO_3Na$ |
| 9) | sodium allyl sulfonate | $CH_2{=}CH{-}CH_2{-}SO_3Na$ |
| 10) | sodium propyne sulfonate | $HC{\equiv}C{-}CH_2{-}SO_3Na$ |
| 11) | sodium propynoxy ethane sulfonate | $HC{\equiv}C{-}CH_2{-}O{-}CH_2{-}CH_2{-}SO_3Na$ |

One may also use other sulfonated compounds as secondary brighteners, either in the form of free acids or as their alkali metal or nickel salts, such as is described in the French Pat. No. 1,096,351.

In accordance with another aspect of this invention, other known nickel electroplating primary brighteners may be associated advantageously, if desired, with the brighteners of formula (I) described above in order to enhance the brilliance, the levelling or other properties of the nickel electrodeposit. Such additional brighteners may be the acetylenic alcohols and their derivatives, the acetylenic amines, the alkynoxy sulfonic acids, etc. i.e. the 2-butyne-1,4-diol, propargylic alcohol, methylbutynol and their derivatives obtained by reaction with ethylene oxide, with propylene oxide or with epichlorohydrin. The concentration of these additional brighteners in the nickel bath is in the range of 0.05–1.0 grams per liter in a manner such that the total concentration of primary brighteners added to the plating bath is in the range of about 0.06–1.05 grams per liter.

The nickel electroplating baths of the invention comprise, for example, a source of nickel ions; i.e. an aqueous solution of one or several nickel salts such as nickel sulfate, nickel chloride, nickel sulphamate or nickel fluoborate; a buffering agent such as boric acid and an alkali metal chloride.

To this basic solution of pH comprised between in the range of about 3.5–5.5 there is added one or several primary brighteners of formula (I) and one or several secondary brighteners, as described above, in the specified concentrations.

A wetting agent is also added to the plating bath, according to known techniques in order to prevent pitting of the nickel deposit.

The following examples illustrate, in a non limitating manner, the application of the invention:

EXAMPLE 1

Preparation of the Compound No. 4 of Table 3

140 grams (1 mole) of mono-arcylate of 2-butyne-1, 4-diol, 778.5 grams of water and 111.5 grams (1 mole) of 1-dimethylamino-propyne-2 hydrochloride are mixed in a reaction vessel and the mixture is heated, under stirring, at the reflux temperature (100°–105° C) for four hours, the pH of the reaction mixture being maintained between 3.5 and 6.5.

The solution obtained, which contains about 25% of the quaternary compound No. 4 of Table 3 has been used as a nickel electroplating brightener, according to this invention, with excellent results.

EXAMPLE 2

Preparation of the Compound No. 8 of Table 3

196.5 grams (1 mole) of the sodium salt of 3-chloro-2-hydroxy-propane sulfonic acid, 1006 grams of water, 20 grams of sodium hydroxide and 119.5 grams (1 mole) of 1-dimethylaminopropyne-2 hydrochloride are mixed in a reaction vessel and the mixture is heated under stirring at the reflux temperature (100°–105° C) for 4 hours. The solution obtained, which contains about 25% of the compound No. 8 of table 3, has been used as a nickel electroplating brightener, according to this invention with excellent results.

EXAMPLE 3

A standard nickel bath of the following composition was made-up:

| | |
|---|---|
| Nickel sulfate | 320 g/l |
| Nickel chloride | 50 g/l |
| Boric acid | 45 g/l |
| pH | 4.0 – 5.0 |

To this basic nickel electroplating bath there was added the brighteners and additives according to the following examples:

EXAMPLE 4

To the bath of Example 3, there was added:

| | |
|---|---|
| o-benzoyl-sulfimide (Na salt) | 3.0 g/l |
| sodium naphthalene trisulfonate | 2.0 g/l |
| compound No. 4 of table 3 | 0.25 g/l |
| sodium lauryl sulfate | 0.2 g/l |

Very bright, uniform, ductile and leveled nickel deposits are obtained from this bath operating at 50°–65° C., 1 to 5 A/dm$^2$ cathodic current density and under cathodic agitation.

EXAMPLE 5

To the bath of Example 3 there is added:

| | |
|---|---|
| o-benzoyl-sulfimide (Na salt) | 2.0 g/l |
| sodium propyne sulfonate | 0.2 g/l |
| compound No. 8 of table 3 | 0.2 g/l |
| compound No. 9 of table 3 | 0.1 g/l |
| 2-butyne-1, 4-diol | 0.1 g/l |
| sodium lauryl ether sulfate | 0.1 g/l |
| Results similar to those of example 4 were obtained. | |

The present invention is not limited to the above examples, these being typical of the many variations possible for those skilled in the art by using other compounds of formula (I) and other combinations with known brighteners.

I claim:

1. In a bath for electrodepositing bright nickel and comprising an acidic aqueous solution of nickel ions, the improvement which comprises, dissolved therein, an effective amount of a nickel brightener of formula:

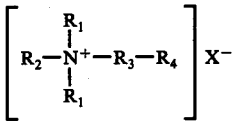

wherein:

$R_1$ is selected from the group consisting of methyl, ethyl and hydroxyethyl;

$R_2$ is selected from the group consisting of alkenyl, alkynyl, hydroxy-substituted alkynyl and lower alkyl-substituted alkynyl;

$R_3$ is selected from the group consisting of lower alkylene, lower alkoxyalkylene, lower alkenylene, lower alkoxyalkenylene, hydroxy-substituted lower alkylene, carboxy-substituted lower alkylene, and hydroxy- and methyl-substituted lower amino-alkylene;

$R_4$ is selected from the group consisting of a sulfonic radical ($-SO_3^-$) and an aliphatic carboxy-ester group

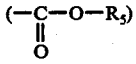

where $R_5$ is alkyl, alkenyl, alkynyl, alkoxyalkynyl, dialkoxyalkynyl, hydroxyalkyl, hydroxyalkenyl, hydroxyalkynyl, haloalkyl, halohydroxyalkyl, halohydroxyalkynyl or hydroxyalkoxyalkynyl; and X is selected from the group consisting of halogen and hydroxy when the positive charge on the nitrogen atom is not otherwise neutralized and X is absent when said charge is neutralized by another substituent of the molecule.

2. A bath as defined in claim 1 wherein said brightener is present in a concentration in the range of about 0.01 to 3.0 grams per liter of bath.

3. A bath as defined in claim 1 wherein said brightener is the compound:

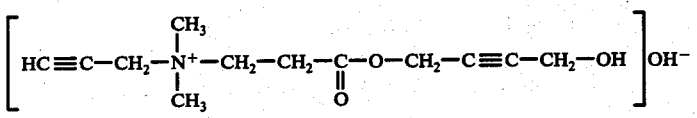

4. A bath as defined in claim 1 wherein the said brightener is the compound:

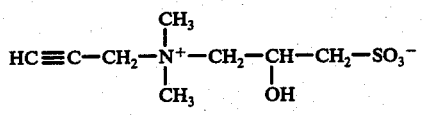

5. A bath as defined in claim 1 which contains additionally, dissolved therein, about 1.0 to 10.0 grams per liter of a secondary brightener selected from the group consisting of o-benzoyl sulfimide, sodium vinyl sulfonate, sodium allylsulfonate, sodium propyne sulfonate, and sodium propynoxy ethane sulfonate.

6. A bath as defined in claim 5 which contains additionally, dissolved therein, about 0.05 to 1.0 grams per liter of an acetylenic alcohol.

7. The bath as defined in claim 6 wherein said alcohol is 2-butyne-1,4-diol; said secondary brightener is O-benzoyl sulfimide; and said brightener is the compound:

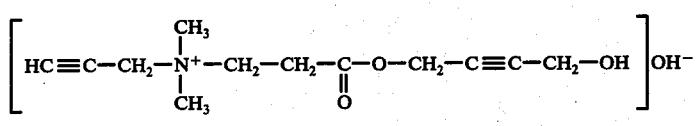

8. In a method of electrodepositing nickel on a basis metal from a bath comprising an acidic aqueous solution of nickel ions and an effective amount of a nickel brightener, the improvement which comprises, as said brightener, a compound of formula:

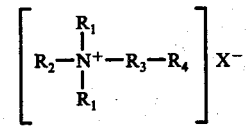

wherein:

$R_1$ is selected from the group consisting of methyl, ethyl and hydroxyethyl;

$R_2$ is selected from the group consisting of, alkenyl, alkynyl, hydroxy-substituted alkynyl and lower alkyl-substituted alkynyl;

$R_3$ is selected from the group consisting of lower alkylene, lower alkoxyalkylene, lower alkenylene, lower alkoxyalkenylene, hydroxy-substituted lower alkylene, carboxy-substituted lower alkylene, and hydroxy- and methyl-substituted lower amino-alkylene;

$R_4$ is selected from the group consisting of a sulfonic radical ($-SO_3^-$) and an aliphatic carboxy-ester group

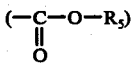

where $R_5$ is alkyl, alkenyl, alkynyl, alkoxyalkynyl, dialkoxyalkynyl, hydroxyalkyl, hydroxyalkenyl, hydroxyalkynyl, haloalkyl, halohydroxyalkyl, halohydroxyalkynyl or hydroxyalkoxyalkynyl; and X is selected from the group consisting of halogen and hydroxy when the positive charge on the nitrogen atom is not otherwise neutralized and X is absent when said charge is neutralized by another substituent of the molecule.

9. The method as defined in claim 8 wherein said brightener is present in a concentration in the range of about 0.01–3.0 grams per liter of bath.

10. The method as defined in claim 8 wherein said brightener is the compound:

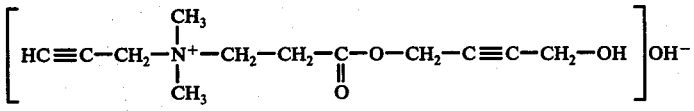

11. The method as defined in claim 8 wherein said brightener is the compound:

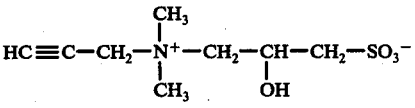

12. The method as defined in claim 8 wherein said bath contains additionally, dissolved therein, about 1.0 to 10.0 grams per liter of a secondary brightener selected from the group consisting of o-benzoyl sulfimide, sodium vinyl sulfonate, sodium allylsulfonate, sodium propyne sulfonate, and sodium propyroxy ethane sulphonate.
13. The method as defined in claim 12 wherein said bath contains additionally, dissolved therein, about 0.05 to 1.0 grams per liter of an acetylenic alcohol.
14. The method as defined in claim 13 wherein said alcohol is 2-butyne-1,4-diol; said secondary brightener is O-benzoyl sulfimide; and said brightener is the compound:
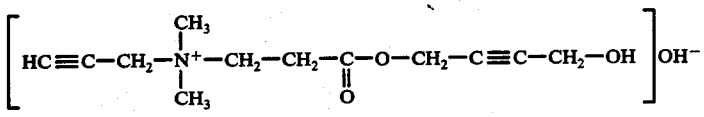
* * * * *